US010773527B2

(12) United States Patent
Watanabe

(10) Patent No.: US 10,773,527 B2
(45) Date of Patent: Sep. 15, 2020

(54) PRINTER

(71) Applicant: TOSHIBA TEC KABUSHIKI KAISHA, Tokyo (JP)

(72) Inventor: Osamu Watanabe, Fuji Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/254,294

(22) Filed: Jan. 22, 2019

(65) Prior Publication Data

US 2019/0248155 A1 Aug. 15, 2019

(30) Foreign Application Priority Data

Feb. 13, 2018 (JP) ..... 2018-023093

(51) Int. Cl.

| | |
|---|---|
| ***B41J 2/32*** | (2006.01) |
| ***B41J 15/04*** | (2006.01) |
| ***B41J 13/10*** | (2006.01) |
| ***B65H 19/30*** | (2006.01) |
| ***B41J 3/407*** | (2006.01) |
| ***B41J 11/04*** | (2006.01) |
| *B41J 3/36* | (2006.01) |

(52) U.S. Cl.

CPC ..... *B41J 2/32* (2013.01); *B41J 3/4075* (2013.01); *B41J 11/04* (2013.01); *B41J 13/106* (2013.01); *B41J 15/042* (2013.01); *B65H 19/30* (2013.01); *B41J 3/36* (2013.01)

(58) Field of Classification Search

CPC . B41J 3/4075; B41J 3/36; B41J 15/042; B41J 15/02

See application file for complete search history.

(56) References Cited

U.S. PATENT DOCUMENTS

| | | | | |
|---|---|---|---|---|
| 5,247,325 A * | 9/1993 | Takahashi | G03B 17/30 | 242/348.4 |
| 6,030,133 A * | 2/2000 | Endo | B41J 3/42 | 400/82 |
| 6,261,013 B1 * | 7/2001 | Bryer | B41J 3/36 | 400/613 |
| 6,364,552 B1 * | 4/2002 | Nehowig | B41J 2/32 | 400/611 |
| 6,609,844 B1 * | 8/2003 | Petteruti | B41J 3/36 | 101/407.1 |

(Continued)

FOREIGN PATENT DOCUMENTS

JP 2015-147647 A 8/2015

*Primary Examiner* — John Zimmermann
(74) *Attorney, Agent, or Firm* — Kim & Stewart LLP

(57) ABSTRACT

A printer includes a main body having a first opening through which a roll of paper can be inserted for installation within the main body and a second opening through which a roll of paper can be inserted for installation within the main body, a first cover configured to open and close the first opening, a second cover configured to open and close the second opening, a printing head attached to the first cover and configured to print an image on paper supplied from the roll of paper, and a roller attached to the second cover and configured to convey the paper from the roll of paper installed within the main body to the printing head. The paper is conveyed by the roller and printing is performed by the printing head when both the first and second covers are closed.

20 Claims, 7 Drawing Sheets

(56) References Cited

U.S. PATENT DOCUMENTS

| | | | | |
|---|---|---|---|---|
| 8,845,219 | B2 * | 9/2014 | Tanaka | B41F 17/10 400/605 |
| 8,882,374 | B2 * | 11/2014 | Colonel | B41J 3/4075 242/596 |
| 9,090,109 | B1 * | 7/2015 | Jo | B41J 15/042 |
| 9,221,574 | B2 * | 12/2015 | Sakaino | B65C 11/0289 |
| 9,333,777 | B2 * | 5/2016 | Block | B41J 15/044 |
| 9,718,636 | B2 * | 8/2017 | Tanaka | B41J 15/044 |
| 2007/0009305 | A1 | 1/2007 | Sakaino et al. | |
| 2009/0046136 | A1 * | 2/2009 | Choi | B41J 35/28 347/214 |
| 2013/0084121 | A1 * | 4/2013 | Watanabe | B41J 3/4075 400/642 |

* cited by examiner

PRINTER

CROSS-REFERENCE TO RELATED APPLICATION

This application is based upon and claims the benefit of priority from Japanese Patent Application No. 2018-023093, filed on Feb. 13, 2018, the entire contents of which are incorporated herein by reference.

FIELD

Embodiments described herein relate generally to a printer.

BACKGROUND

In the related art, a label printer is widely used in an office such as a back office in a grocery store. A typical label printer requires a user to open and close the housing at the time of paper sheet replenishment and maintenance, which requires an additional space around the printer. Thus, when the office space is limited, it is difficult for the user to replenish printing paper and handle the maintenance.

For example, if the printer includes an opening and closing lid on a top surface of the housing, an additional space above the housing is needed. If the printer includes an opening and closing lid on the front side of the housing, an additional space in front of the housing is needed.

In this way, an installation location for a printer may be limited due to the opening and closing mechanism of the printer, especially when the printer needs to be installed in a small office.

DETAILED DESCRIPTION

One or more embodiments provide a printer with a high degree of freedom in the installation thereof.

The printer according to an embodiment includes a main body having a first opening through which a roll of paper can be inserted for installation within the main body and a second opening through which a roll of paper can be inserted for installation within the main body, a first cover configured to open and close the first opening, a second cover configured to open and close the second opening, a printing head attached to the first cover and configured to print an image on paper supplied from the roll of paper, and a roller attached to the second cover and configured to convey the paper from the roll of paper installed within the main body to the printing head. The paper is conveyed by the roller and printing is performed by the printing head when both the first and second covers are closed.

Figure 1:
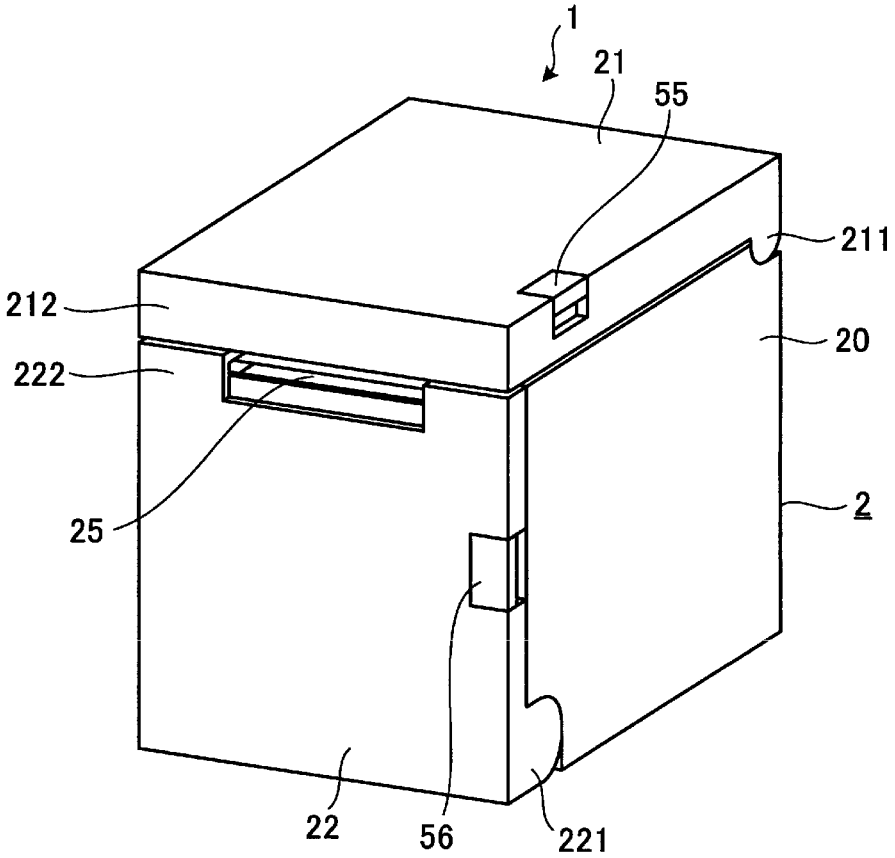
FIG. 1 illustrates a perspective view of an exterior of a printer according to an embodiment.

One or more embodiments will be described with reference to the figures. FIG. 1 illustrates a perspective view of an exterior of the printer 1 according to an embodiment. The printer 1 includes a housing 2. The form of the housing 2 is box-shaped (for example, an approximate cuboid or an approximate cube). The housing 2 includes a main body portion 20 that includes a main portion of the housing 2, and a first cover 21 and a second cover 22 that constitute a portion of the housing 2.

Figure 2:
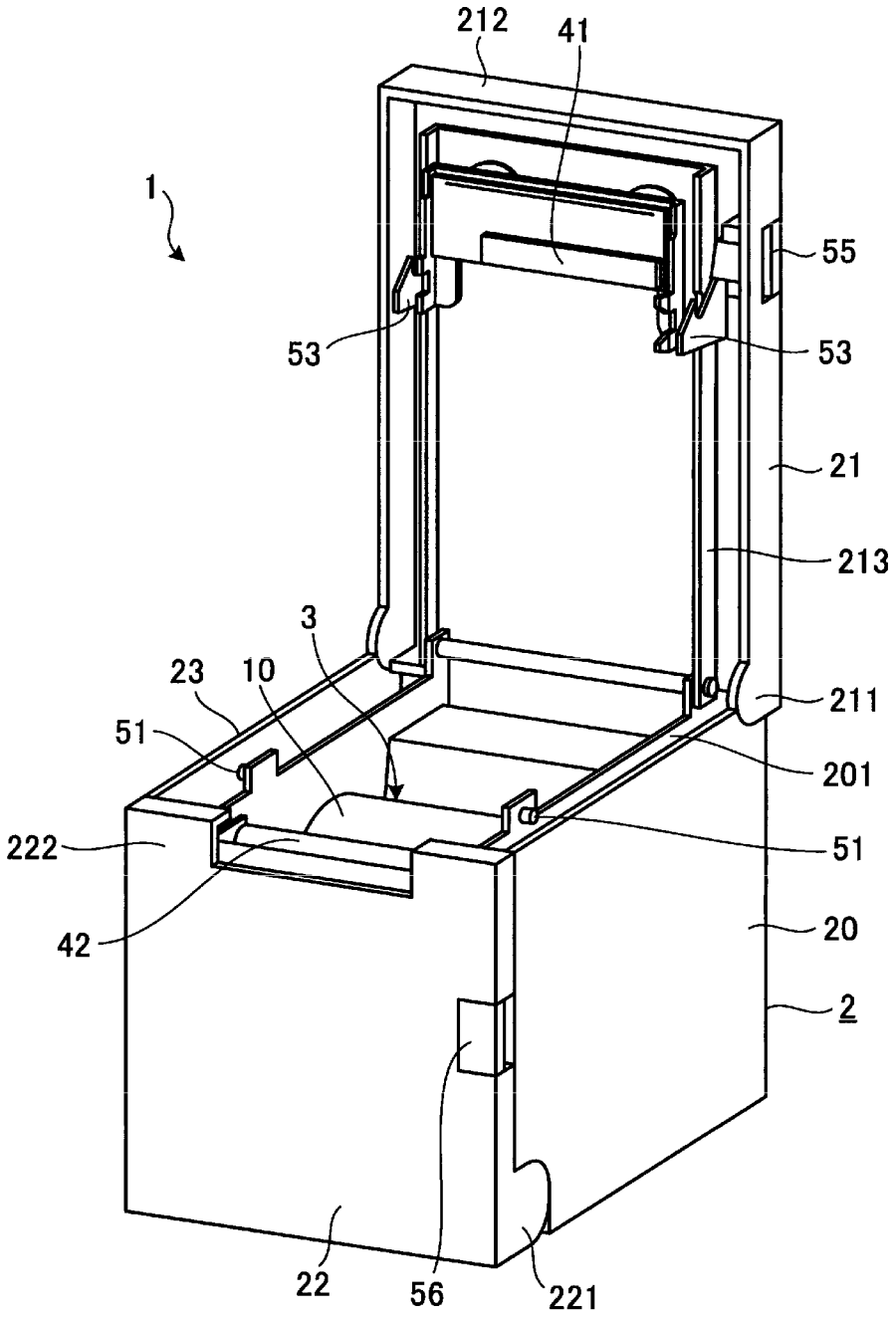
FIG. 2 illustrates a perspective view of the printer with a first cover opened.
Figure 3:
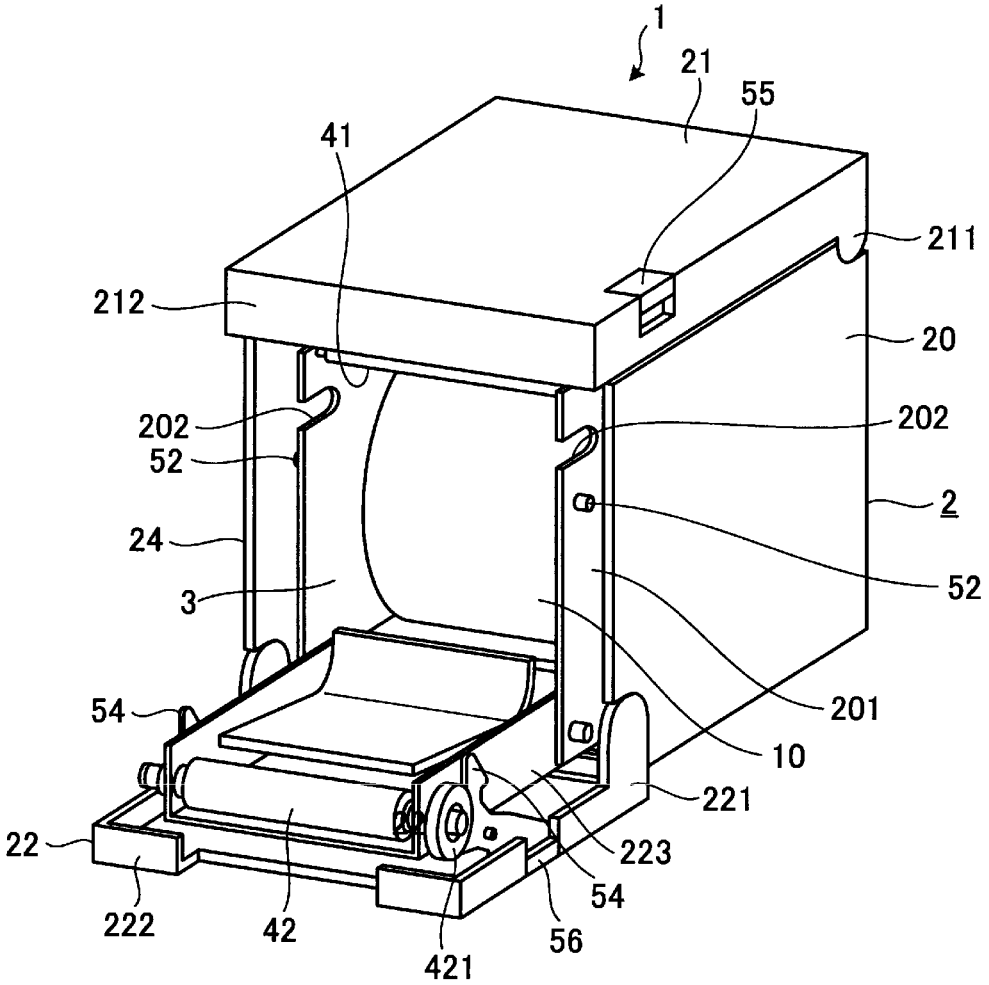
FIG. 3 illustrates a perspective view of the printer with a second cover opened.
Figure 4:
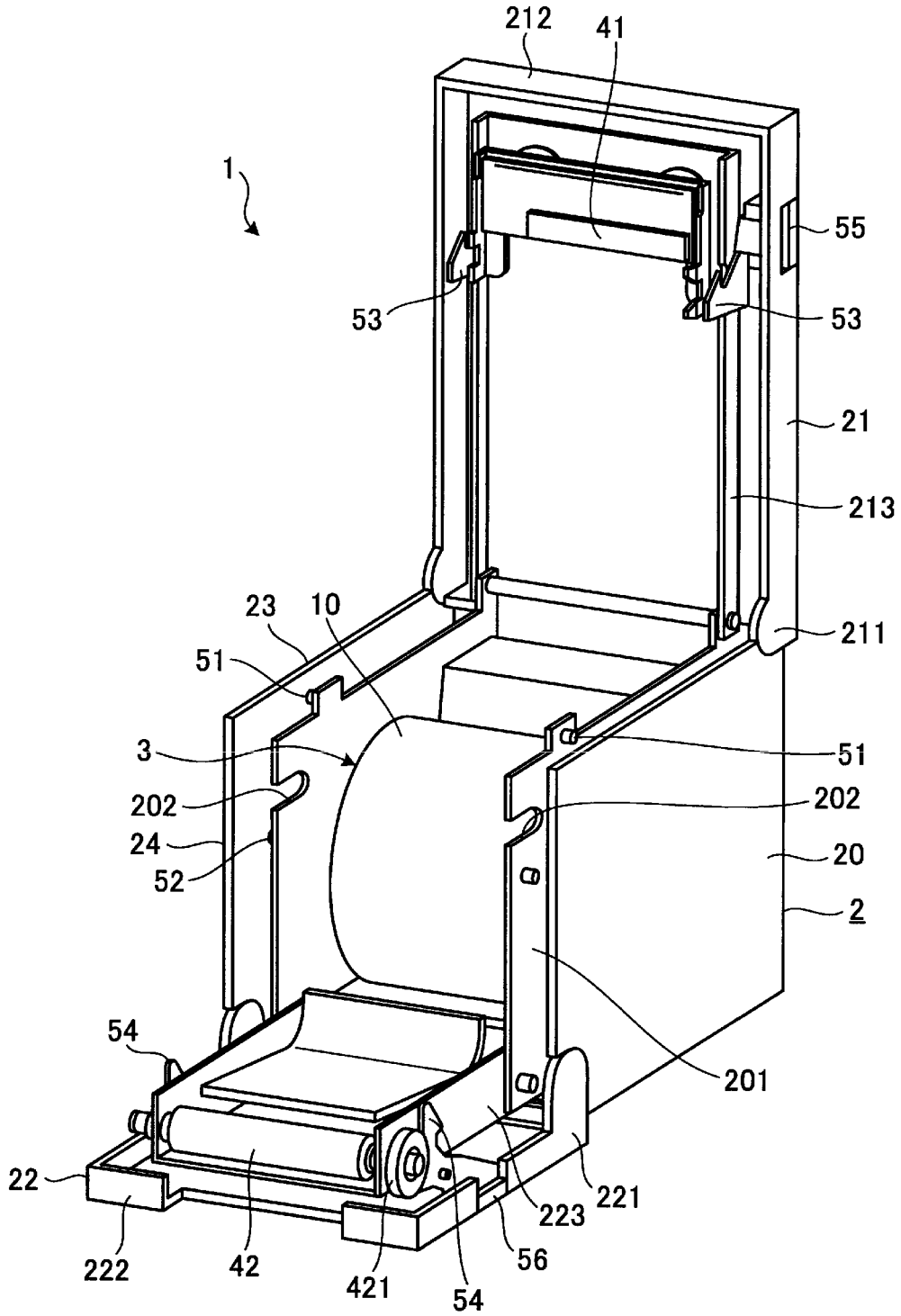
FIG. 4 illustrates a perspective view of the printer with the first cover and the second cover opened.

FIG. 2 illustrates a perspective view of the printer 1 with the first cover 21 opened. FIG. 3 illustrates a perspective view of the printer 1 with the second cover 22 opened. FIG. 4 illustrates a perspective view of the printer 1 with the first cover 21 and the second cover 22 opened. The main body portion 20 includes the openings 23 and 24 on two different surfaces of the housing 2. The first cover 21 opens and closes one opening 23. The second cover 22 opens and closes the other opening 24.

Figure 5:
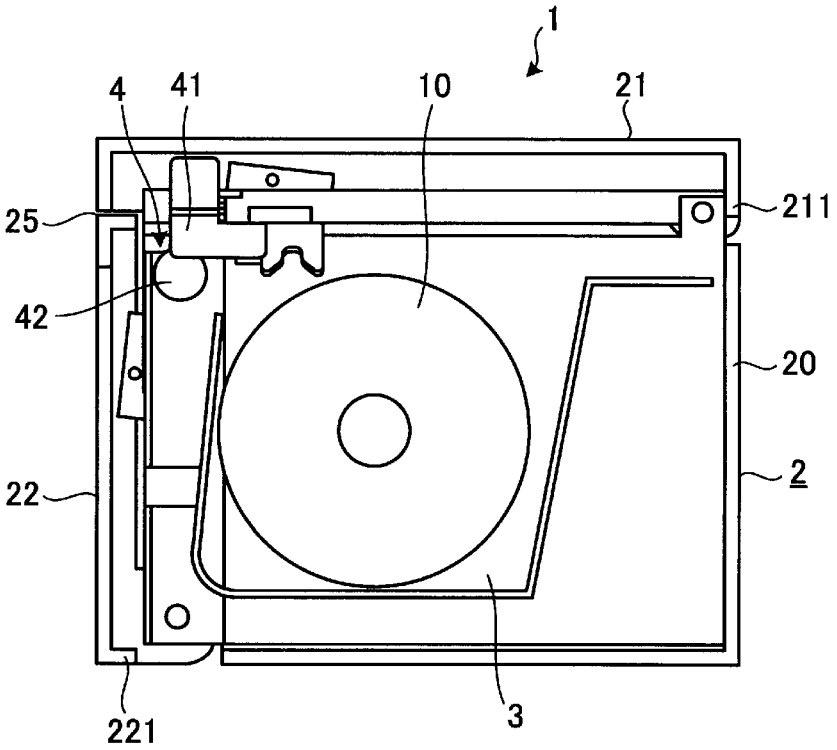
FIG. 5 illustrates a longitudinal side view of the printer with the first cover and the second cover closed.
Figure 6:
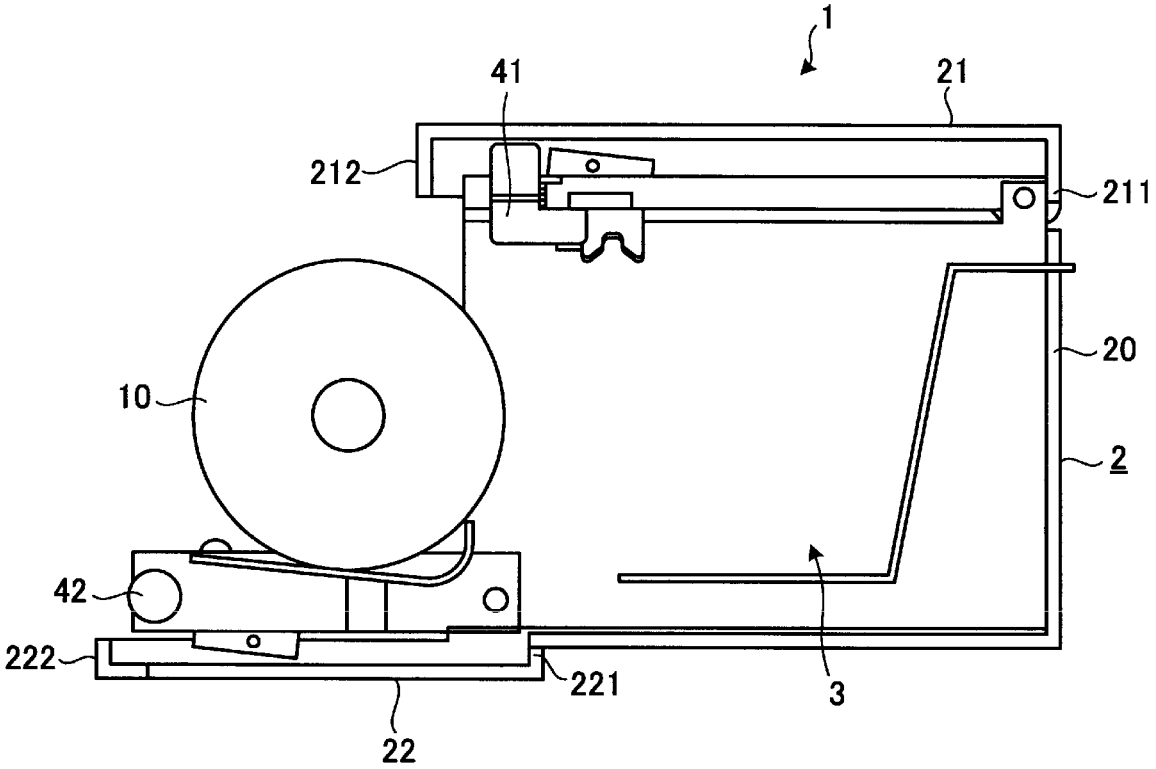
FIG. 6 illustrates a longitudinal side view of the printer with the second cover opened.

FIG. 5 illustrates a longitudinal side view of the printer 1 with the first cover 21 and the second cover 22 closed. FIG. 6 corresponds to FIG. 3 and illustrates a longitudinal side view of the printer 1 with the second cover 22 opened. The printer 1 further includes a paper sheet storage portion 3 and a print unit 4.

The paper sheet storage portion 3 is provided inside the main body portion 20, stores a roll paper sheet 10 and holds the paper sheet such that the roll paper sheet rotates freely. The roll paper sheet 10 is a roll of paper sheet wound, for example, a label roll or a receipt roll. The label roll is a strip of base paper sheet on which labels are stuck at predetermined intervals wound. The receipt roll is a strip of paper sheet wound. Each of the openings 23 and 24 enables the paper sheet replenishment or replacement in the paper sheet storage portion 3.

Here, the paper sheet storage portion 3 may hold the roll paper sheet 10 in a so-called throw-in way or may hold the core which is inserted into the hollow portion of the roll paper sheet 10 to become a shaft of rotation with a predetermined holding unit.

The print unit 4 prints on the paper sheet drawn out from the paper sheet storage portion 3. The print unit 4 includes a print head 41 and a platen roller 42.

The embodiment provides the openings 23 and 24 on two adjacent surfaces of the housing 2 and the paper sheet discharge opening 25 that discharges the paper sheet between the first cover 21 and the second cover 22 (refer to FIGS. 1 and 5).

Further, according to the embodiment, one end 211 of the first cover 21 is attached to the main body portion 20 such that the first cover 21 is rotatable and opens and closes the opening 23 in accordance with the rotation. The other end 212 of the first cover 21 faces the paper sheet discharge opening 25. Further, one end 221 of the second cover 22 is attached to the main body portion 20 such that the second cover 22 is rotatable and opens and closes the opening 24 in accordance with the rotation. The other end 222 of the second cover 22 faces the paper sheet discharge opening 25.

The print head 41 is attached to the first cover 21, and the platen roller 42 is attached to the second cover 22. When the first cover 21 closes the opening 23 and the second cover 22 closes the opening 24, the platen roller 42 comes into contact with the print head 41 and the printer 1 becomes ready for printing.

The print head 41 is, for example, a thermal head. The platen roller 42 rotates by the driving force of a stepping motor or the like being transmitted through the gear 421 (refer to FIG. 4 or the like). When the platen roller 42 rotates, the paper sheet nipped between the platen roller 42 and the print head 41 is conveyed.

Figure 7:
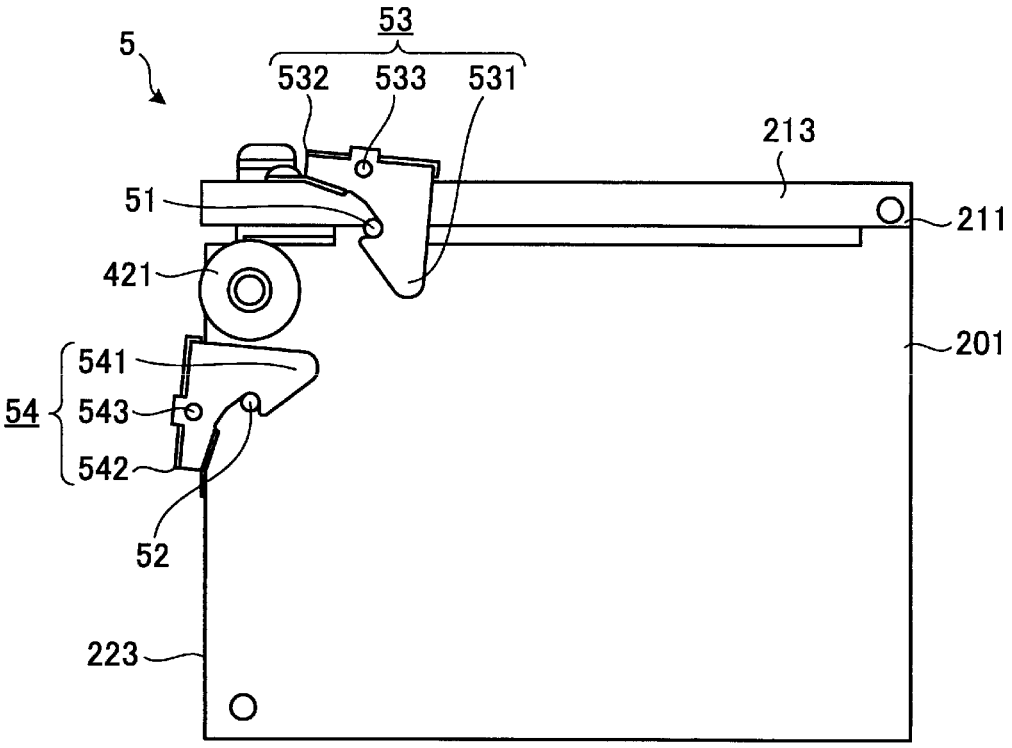
FIG. 7 illustrates a side view inside the printer showing an exterior of a lock unit.

FIG. 7 illustrates a side view inside the printer 1 showing an exterior of the lock unit 5. In FIG. 7, the exterior portion of the housing 2 is removed from the printer 1. Hereinafter, the main body portion 20 without the exterior (frame portion) will be referred to as the main body frame 201, the first cover 21 without the exterior will be referred to as the first frame 213, and the second cover 22 without the exterior will be referred to as the second frame 223. The main body frame 201 is provided with a notch 202 (refer to FIG. 4) for avoiding the rotation shaft of the gear 421 and the platen roller 42. When the second cover 22 is positioned for closing the housing 2, a portion around the notch 202 of the main body frame 201 is positioned between the gear 421 and the platen roller 42, and the rotation shaft of the gear 421 enters the notch 202.

The printer 1 further includes a lock unit 5. The lock unit 5 includes the pins 51 and 52, the levers 53 and 54, and the buttons 55 and 56 (refer to FIG. 1).

The levers 53 and 54 have hook-shaped lock ends 531 and 541, the operation ends 532 and 542 to which a force from an operator is transmitted, and the rotation centers 533 and 543. The first cover 21 pivotally supports the lever 53 at the rotation center 533. The second cover 22 pivotally supports the lever 54 at the rotation center 543.

The lock end 531 is provided at a pair of positions nipping the end portion of the first frame 213 near the paper sheet discharge opening 25 in the width direction. Further, the lock end 541 is provided at a pair of positions nipping the end portion of the second frame 223 near the paper sheet discharge opening 25 in the width direction.

In the side view illustrated in FIG. 7, the operation end 532 is positioned on the opposite side of the rotation center 533 from the lock end 531 and is provided in a portion connecting a pair of lock ends 531. The operation end 542, in the side view illustrated in FIG. 7, is positioned on the opposite side of the rotation center 543 from lock end 541 and is provided in a portion connecting a pair of lock ends 541.

The pin 51 is provided on the main body frame 201 and catches the lever 53 when the first cover 21 is closed. The pin 52 is provided on the main body frame 201 and catches the lever 54 when the second cover 22 is closed.

The button 55 is provided on the first cover 21, is positioned in the vicinity of the operation end 532 of the lever 53, and transmits the force received from the operator to the operation end 532 to rotate the lever 53.

In such a configuration, the printer 1 draws out the roll paper sheet 10 stored and held in the paper sheet storage portion 3 by rotating the platen roller 42, prints on the drawn-out paper sheet with the print head 41, and discharges the paper sheet from the paper sheet discharge opening 25.

Further, for the printer 1 of such a configuration, the operator opens the first cover 21 or the second cover 22 and replenishes and replaces the paper sheet in the paper sheet storage portion 3. Further, the operator closes the opened first cover 21 or the second cover 22 with a tip end of the paper sheet being drawn outside the housing 2 from the roll paper sheet 10 which is inserted in the paper sheet storage portion 3. In this way, the paper sheet is nipped by the print head 41 and the platen roller 42, and the tip end of the paper sheet sticks out the housing 2 from the paper sheet discharge opening 25.

When the replenishment and the replacement of the paper sheet or the maintenance of the printer 1 is needed, the operator using the printer 1 can choose which one of the first cover 21 and the second cover 22 to open. In arranging the environment in which the printer 1 is to be installed, the operator only needs to maintain a state in which either the first cover 21 or the second cover 22 can be opened. In other words, according to the embodiment, the operator can easily find a location for installing the printer 1 even when the office space is limited.

The printer 1 includes the openings 23 and 24 that enable the paper sheet replenishment on the two different surfaces of the housing 2, and each of the openings 23 and 24 is opened and closed by the first cover 21 and the second cover 22, so that it is possible to use either the first cover 21 or the second cover 22 that can be opened, depending on the installation environment of the printer 1.

Further, since the printer 1 includes the openings 23 and 24 on two adjacent surfaces of the housing 2, by opening both the first cover 21 and the second cover 22, it is easy for the operator to clean up the inside of the apparatus.

The print head 41 is attached to the first cover 21 and the platen roller 42 is attached to the second cover 22 in the printer 1. Therefore, even when either the first cover 21 or the second cover 22 is opened, it is possible to separate the print head 41 and the platen roller 42 from each other. By closing the housing 2, it is possible to easily nip the paper sheet between the print head 41 and the platen roller 42.

Further, according to the embodiment, the first cover 21 and the second cover 22 is rotatably attached to the main body portion 20 such that the housing 2 is configured to be opened and closed in accordance with the rotation. According to the embodiment, it is possible to provide the first cover 21 and the second cover 22 to be slidable with respect to the main body portion 20 so as to open and close the housing 2 in accordance with the slide. However, compared with the latter configuration, the former keeps the cost of materializing the configuration for opening and closing low easily.

The printer 1 using the roll paper sheet 10 as a paper sheet is described as an example according to the embodiment. However, in practice, the configuration for opening and closing two different surfaces of the housing can be applied to a printer that prints on other forms of paper. Further, according to the embodiment, the printer 1 with the paper sheet discharge opening 25 facing forward is illustrated in FIG. 1 and the like. However, in practice, the printer 1 may be used with the paper sheet discharge opening 25 facing another direction such as upward.

Further, according to the embodiment, each of the openings 23 and 24 corresponds to an entire surface of the housing 2. However, in practice, the opening may correspond to a part of, not an entire, surface of the housing 2.

Further, according to the embodiment, the levers 53 and 54 lock or unlock by rotation, but, in practice, the operation of the levers 53 and 54 may be other than the rotation.

Modification Example

Figure 8:
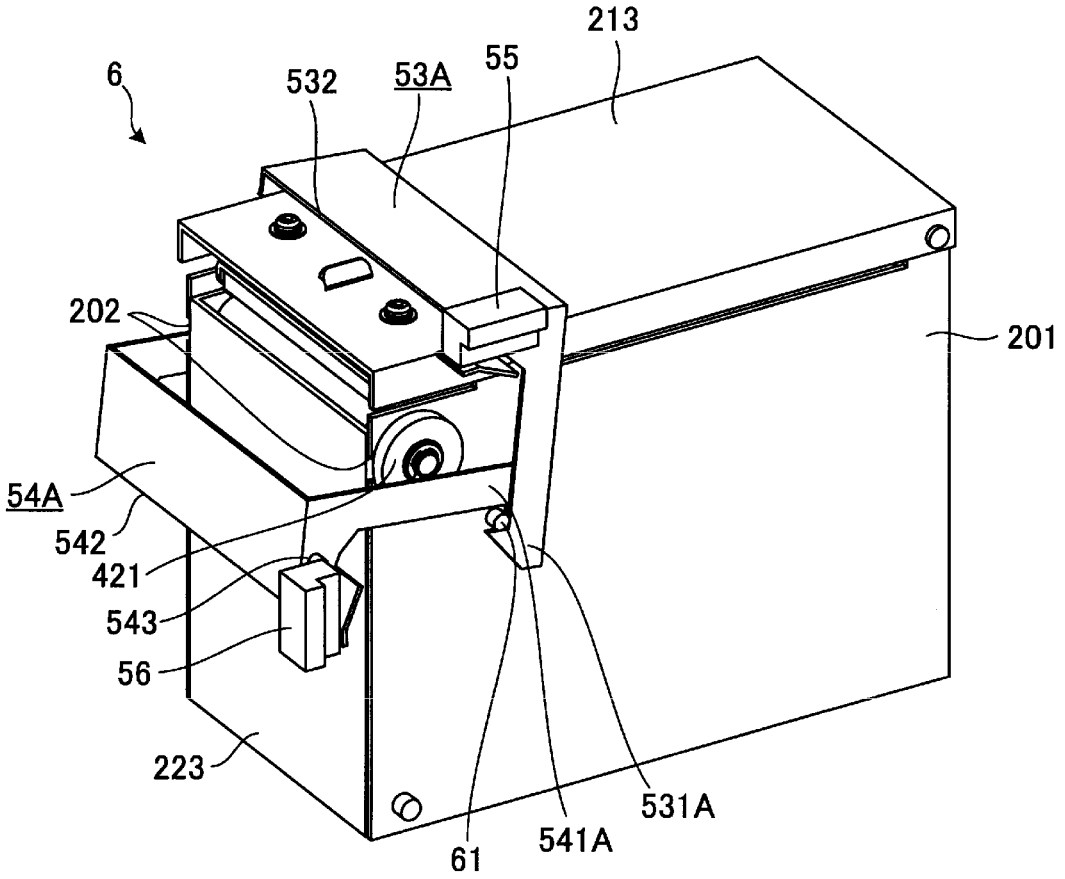
FIG. 8 illustrates a perspective view inside the printer showing the exterior of another example of a lock unit.

Hereinafter, a modification example of the lock unit will be described. FIG. 8 illustrates a perspective view of the interior of the printer 1 showing the exterior of another example of the lock unit (i.e., lock unit 6). In describing the lock unit 6, the same reference numerals are used for the same parts as the parts of the lock unit 5, and for the parts corresponding to, but different from, each other, a suffix A is used at the end.

The lock unit 6 includes a pin 61 instead of two separate pins 51 and 52, a lever 53A into which the lever 53 is deformed in conformity with the pin 61, and a lever 54A into which the lever 54 is deformed in conformity with the pin 61. The pin 61 positions the first cover 21 and positions the second cover 22.

The lock ends 531A and 541A of the levers 53A and 54A are longer than the lock ends 531 and 541 as illustrated in FIG. 7, and the tip ends are separated from the rotation centers 533 and 543. The pin 61 is provided at a position where the lock ends 531A and 541A intersect with each other.

Therefore, by commonizing the pin 61, it is possible to obtain the printing accuracy in the printer 1 easily. This is because the positional accuracy of the print head 41 and the platen roller 42 in the print unit 4 is important for printing accuracy. In the printer 1, to optimize the positional accuracy between the print head 41 and the platen roller 42, the positional accuracy of the first cover 21 with respect to the main body portion 20 has to be improved while the positional accuracy of the second cover 22 with respect to the main body portion 20 also has to be improved.

If the pin 51 that fixes the first cover 21 and the pin 52 that fixes the second cover 22 are separately provided on the main body portion 20 like the lock unit 5, the total of the positional error of each of the pin 51 and the pin 52 affects the print unit 4.

If the first cover 21 and the second cover 22 are both fixed to one pin 61 which is provided in the main body portion 20 as in the lock unit 6, the cause of the position error is one. Thus, the error management becomes relatively easy.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer comprising:

a main body having a storage space for storing a roll of paper, a first opening through which the roll of paper can be inserted for installation within the storage space, and a second opening through which the roll of paper can be inserted for installation within the storage space;

a first cover configured to open and close the first opening;

a second cover configured to open and close the second opening;

a printing head attached to the first cover and configured to print an image on paper supplied from the roll of paper; and a roller attached to the second cover and configured to convey the paper from the roll of paper installed within the main body to the printing head, wherein the paper is conveyed by the roller and printing is performed by the printing head when both the first and second covers are closed.

2. The printer according to claim 1, wherein the first and second covers form two contiguous and mutually perpendicular surfaces of the printer when the first and second covers are closed.

3. The printer according to claim 2, wherein the second cover has a discharge port at one end thereof.

4. The printer according to claim 3, wherein the printed paper is discharged through the discharge port.

5. The printer according to claim 1, wherein one end of the first cover is attached to the main body such that the first cover opens and closes in a first direction, and one end of the second cover is attached to the main body such that the second cover opens and closes in a second direction different from the first direction.

6. The printer according to claim 5, wherein the discharge port is formed at the other end of the second cover.

7. The printer according to claim 1, wherein the main body has first and second pins, and the first and second covers have first and second locking mechanisms that engage with the first and second pins when the first and second covers are closed.

8. The printer according to claim 1, wherein the main body has a pin, and the first and second covers have first and second locking mechanisms that engage with the pin when the first and second covers are closed.

9. The printer according to claim 1, wherein the paper is label paper.

10. The printer according to claim 1, wherein the paper is receipt paper.

11. A printer comprising:

a main body having a storage space for storing a roll of paper, a first cover configured to open and close in a first direction, and a second cover configured to open and close in a second direction opposite to the first direction;

a printing head attached to the first cover and configured to print an image on paper supplied from the roll of paper; and a roller attached to the second cover and configured to convey the paper from the roll of paper installed within the storage space to the printing head, wherein the roll of paper can be inserted for installation within the storage space through each of a first opening that is covered by the first cover and a second opening that is covered by the second cover.

12. The printer according to claim 11, wherein the first and second covers form two contiguous and mutually perpendicular surfaces of the printer when the first and second covers are closed.

13. The printer according to claim 12, wherein the second cover has a discharge port at one end thereof.

14. The printer according to claim 13, wherein the printed paper is discharged through the discharge port.

15. The printer according to claim 11, wherein one end of the first cover is fixed to the main body such that the first cover opens and closes in a rotatable manner, and one end of the second cover is fixed to the main body such that the second cover opens and closes in a rotatable manner.

16. The printer according to claim 15, wherein the discharge port is formed at the other end of the second cover.

17. The printer according to claim 11, wherein
the main body has first and second pins, and
the first and second covers have first and second locking mechanisms that engage with the first and second pins when the first and second covers are closed.

18. The printer according to claim 11, wherein
the main body has a pin, and
the first and second covers have first and second locking mechanisms that engage with the pin when the first and second covers are closed.

19. The printer according to claim 11, wherein
the paper is label paper.

20. The printer according to claim 11, wherein
the paper is receipt paper.

* * * * *